US006032015A

United States Patent [19]

Umeda et al.

[11] Patent Number: 6,032,015

[45] **Date of Patent: *Feb. 29, 2000**

[54] APPARATUS FOR PRINTING ON BOTH SIDES OF AN IMAGE PRINTING MEDIUM BY ONE PROCESS

[75] Inventors: Takao Umeda; Ryoji Kojima; Masayasu Anzai; Michio Yokosuka; Katsuhiko Suzuki; Tadahiro Kaneko, all of Ibaraki, Japan

[73] Assignee: Hitachi Koki Co, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,425

[22] Filed: Jan. 20, 1998

Related U.S. Application Data

[62] Division of application No. 08/595,221, Feb. 1, 1996, Pat. No. 5,848,323.

[30] Foreign Application Priority Data

Feb. 6, 1995 [JP] Japan ..... 7-17871
Mar. 17, 1995 [JP] Japan ..... 7-58661

[51] Int. Cl.[7] ..... G03G 15/22

[52] U.S. Cl. ..... 399/306; 399/333; 399/384

[58] Field of Search ..... 399/328, 330, 399/331, 332, 333, 364, 384, 363, 400, 322, 309, 306; 219/216; 355/24

[56] References Cited

U.S. PATENT DOCUMENTS

| | | | |
|---|---|---|---|
| 3,580,670 | 5/1971 | Bhagat | 399/306 |
| 4,219,327 | 8/1980 | Idstein | 432/60 |
| 4,427,285 | 1/1984 | Stange | 399/306 |
| 4,731,631 | 3/1988 | Monkelbaan et al. | 399/306 |
| 4,814,819 | 3/1989 | Torino et al. | 399/331 |
| 4,934,930 | 6/1990 | Soga | 432/60 |
| 4,958,187 | 9/1990 | Tsuchiya et al. | 399/306 |
| 5,289,246 | 2/1994 | Menjo | 399/333 |
| 5,475,481 | 12/1995 | Nishikawa et al. | 399/297 |
| 5,479,248 | 12/1995 | Yamaguchi et al. | 399/335 |
| 5,486,908 | 1/1996 | Miyamoto et al. | 399/328 |
| 5,491,545 | 2/1996 | Kopp et al. | 399/322 |
| 5,623,331 | 4/1997 | Kaneko et al. | 399/378 |
| 5,689,789 | 11/1997 | Moser | 399/331 |
| 5,708,951 | 1/1998 | Saito et al. | 399/333 |

FOREIGN PATENT DOCUMENTS

| | | |
|---|---|---|
| 51-13022 | 4/1976 | Japan . |
| 1-026879 | 1/1989 | Japan . |
| 2-293772 | 12/1990 | Japan . |
| 3-177874 | 8/1991 | Japan . |

*Primary Examiner*—Robert Beatty
*Attorney, Agent, or Firm*—Sughrue, Mion, Zinn, Macpeak & Seas, PLLC

[57] ABSTRACT

A fixing system for fixing toner images onto an image printing system such that the image printing medium bearing the toner images on the obverse side and the reverse sides thereof is passed through a nip area between a pair of fixing rollers. In the nip area, a rotation speed of a first fixing roller, which comes into contact with a not-yet fixed toner image, which is formed on the obverse side of the image printing medium, is set to be substantially equal to a rotation speed of a second fixing roller, which comes in contact with a not-yet fixed toner image, formed on the reverse side of the image printing medium. This is accomplished by setting the diameters of the various layers of the first fixing roller to be equal to that of the second fixing roller. When the image printing medium is moved through the nip area by the fixing rollers, a moving speed of the upper side of the image printing medium is equal to that of the lower side thereof. Thus, stresses on the image printing medium are not caused, and no character blur takes place.

6 Claims, 8 Drawing Sheets

APPARATUS FOR PRINTING ON BOTH SIDES OF AN IMAGE PRINTING MEDIUM BY ONE PROCESS

This is a divisional of Application Ser. No. 08/595,221 filed Feb. 1, 1996, now U.S. Pat. No. 5,848,323.

BACKGROUND OF THE INVENTION

1. Field of the Invention

The present invention relates to an electrostatic printing apparatus such as a xerography-basis printer or a xerography-basis copying machine, and more particularly to a fixing system that is adequately used for printing images on both sides of a paper or a plastic sheet, and an electrostatic both-side printing apparatus which is capable of simultaneously printing images on both sides of an image printing medium, such as a paper or a plastic sheet, by one process.

2. Description of the Related Art

The both-side printing system for printing images on both sides of an image printing medium, e.g., a paper, is categorized into two systems; a first printing system of the one-process type in which toner images transferred onto both sides of an image printing medium are simultaneously fixed thereto, and a second printing system of the two-process type in which a first toner image is transferred and fixed on one side of an image printing medium, and then a second toner image is transferred and fixed onto the other side of the image printing medium.

The concept of the both-side printing system of the one process type has been known for long. Japanese Patent Examined Publication No. Sho. 51-13022, for example, discloses the construction of this type of the both-side printing system, and further a technique to correct an out-of register between the images transferred onto both sides of the image printing medium by using an exposure timing and the shape of a photoreceptor.

Most of the both-side printing systems, available on the market, are of the two process type. The both-side printing system of the one process type has never been put into practical use.

There are some reasons why the both-side printing system of the one process has never been put into practical use. The reasons are as follows:

(1) Unstable transferring of toner images to both sides of a image printing medium:

a) The both-side printing system disclosed in Japanese Patent Unexamined Publication No. Sho. 51-13022 as referred to above uses transferring corotrons for transferring toner images from the first and the second toner image bearing means to an image printing medium.

The problems which arise in the process of transferring the toner images to both sides of the medium in the publication will be described with reference to FIG. 1.

As shown, a first toner image bearing means and a second toner image bearing means are disposed on both sides of an image printing medium 110. The first toner image bearing means consists of a photoreceptor in the form of a drum, which is constructed such that a photoconductive layer 102*a* made of SeTe is layered on the surface of a conductive substrate 101*a* made of aluminum. Similarly, the second toner image bearing means consists of a photoreceptor in the form of a drum, which is constructed such that a photoconductive layer 102*b* made of SeTe is layered on the surface of a conductive substrate 1*b* made of aluminum.

A charger 103*a* applies positive charge onto the surface of the first toner image bearing means, and an exposure unit 105*a* irradiates the same with light containing image information, to thereby form an electrostatic latent image thereon. A developing unit 106 develops the latent image into a visual image 107 with toner. Reference numeral 112*a* designates an erasing lamp, and 113*a*, a drum cleaner.

In transferring the first toner image from the first toner image bearing means to the image printing medium 110, a transferring corotron 131 applies negative charge 130 to the lower side of the image printing medium 110. Accordingly, an electrostatic force exerts between the positively charged second toner image and the negative charge 130, so that toner of a second toner image, positively charged, formed on the second toner image bearing means, flies to the image printing medium 110 before an image transferring position. This toner flying phenomenon is called a "before-transfer toner scattering". The phenomenon greatly deteriorates the quality of the resultant image.

b) When the transferring of the second toner image is carried out, the first toner image 107 is not yet fixed to the image printing medium 110. In this state, an electric field developed by a transferring corotron 120 causes the toner of the first toner image to move to the corotron wire, although it depends on the polarity of the second toner image. As a result, the first toner image may be disturbed or the inside of the corotron may be soiled with the toner.

(2) When the image printing medium 110 is transported at a high speed, part of the toner of a toner image attached but not fixed to the lower side (reverse side) of the image printing medium 110 drops by gravity. This leads to the deterioration of the image quality.

The above-mentioned Japanese Patent Unexamined Publication No. Sho. 51-13022 also discloses a radiated heat fixing system of the noncontact fixing method for the fixing system of simultaneously fixing toner images formed on both sides of the image printing medium. The contact fixing system using the fixing rolls, which is capable of simultaneously fixing the toner images on both sides of the image printing medium has not been developed and marketed. To fix toner images on both sides of the image printing medium by the contact fixing system, a toner image is fixed on the obverse side, for example, of a paper, the paper is reversed, a toner image is formed on the reverse side of the paper, and transported to a fixing stage where it is fixed on the reverse side. The pressure roll of the fixing rolls contains a heat source to supply the quantity of heat to the paper for making up for the deficiency of heat.

The heat roll fixing system has the following problems.

1) The problems of the heat roll fixing system, which arises when it is used for fixing toner images on both sides of the image printing medium, will be described with reference to FIGS. 2A and 2B.

The heat roll fixing performance is determined by heat roll temperature, nip pressure, and nip width (fixing time). To secure the nip area, one of the fixing rollers is a pressure roller with an elastic layer formed thereon. As shown in FIGS. 2A and 2B, the upper fixing roller 15 is a hard roller as a drive roller, and the lower fixing roller 16 is a soft roller with an elastic layer thereon as a follower roller.

The fixing roller 15 is constructed such that a release resin layer 20*a* made of fluorine resin, for example, is formed on the surface of a metallic roll 21*a* made of aluminum, for example, and the metallic roll 21*a* contains a halogen lamp 22*a*. The fixing roller 16 is constructed such that an elastic layer 23 (of h thickness) made of silicon rubber is formed on the surface of a metallic roll 21*b* made of aluminum, a release layer 20*b* made of fluorine resin is formed on the elastic layer, and the metallic roll 21*b* contains a halogen lamp 22*b* therein. Both the fixing rollers are compressed together by a fixed load, to thereby form a nip area of the width W. Normally, the radius $r_1$ of the upper hard roll 15 is equal to the radius $r_2$ of the lower soft roll 16. The hard roll is used as a drive roll, and the soft roll is used as a follower roll. When those fixing rolls are compressed together, the lower soft roll is deformed since it has the elastic layer 23. The effective radius $r_2$ is changed to the radius $r_2$, in the nip area. As a result, the effective radius $r_2$, of the lower soft roll >the radius $r_1$ of the upper hard roll. When the rotation angular speeds of the upper and the lower rollers are equal to each other, a moving speed v2 of the upper hard roll >a moving speed v1 of the lower soft roll, causing a speed difference. Accordingly, as illustrated in FIG. 2A, a moving speed of the lower side of the image printing medium is larger than that of the upper side thereof, so that stresses Fc and Fe of different directions act on the toner images on the upper and the lower sides of the image printing medium. Therefore, the fixed toner images 19*a* and 19*b* after passing through the nip are blurred, viz., a character blur occurs (FIG. 2B). This character blur phenomenon is not observed when an image is printed on one side of the image printing medium, and when an image is printed on one side of the image printing medium, and another image is printed on the other side thereof.

2) In the electrostatic image printing apparatus using such a fixing system, problems of character blur and offset arise when the upper and the lower fixing rolls are retracted from the image printing medium at the time of starting and stopping the both-side printing operation, and the fixing rolls are compressed together.

SUMMARY OF THE INVENTION

The present invention has been made in view of the above, and therefore an object of the present invention is to provide an electrostatic both-side printing system of the one process type which is capable of transferring toner images of high quality onto both sides of an image printing medium, stably attaching the toner images onto the medium, and simultaneously fixing the toner images onto the medium.

Another object of the present invention is to eliminate a character blur caused in the nip area when a heat roll fixing system operates for fixing.

Still another object of the present invention is to solve the problems of character blur and offset arise when the upper and the lower fixing rolls are retracted from the image printing medium at the time of starting and stopping the both-side printing operation, and the fixing rolls are compressed together.

To achieve the above object, according to a first aspect of the invention, there is provided an electrostatic both-side printing system. In the both-side printing system, first image forming means, which includes a toner image bearing means (photoreceptor drum), a charger, an exposure unit, and a developing unit, is provided upstream of an image printing medium, such as a paper or a plastic sheet, when viewed in the transporting direction of the image printing medium, and second image forming means, which includes a toner image bearing means (photoreceptor drum), a charger, an exposure unit, and a developing unit, is provided downstream of the image printing medium. The charge polarity of a photoreceptor of the first image forming means is the same as of a photoreceptor of the second image forming means.

A medium transporting path for transporting the image printing medium is formed between the first and the second image forming means.

A first transferring unit is located facing the first image forming means with the medium transporting path intervening therebetween. The first transferring unit transfers a toner image from the photoreceptor of the first image forming means onto the image printing medium by applying no charge onto the rear side of the image printing medium, which does not face the first image forming means.

A second transferring unit for transferring a toner image from the photoreceptor of the second image forming means onto the image printing medium is located facing the second image forming means with the image printing medium with the medium transporting path intervening therebetween, in a state that the second transferring unit is apart from a first toner image formed on the image printing medium by the first image forming means.

Charge quantity adjusting means for setting the charge polarity of a first toner image to be the same as the voltage polarity of the second transferring unit is located upstream of the second transferring unit but downstream of a first developing unit.

With such a construction, the first and the second image forming means, and the first and the second transferring units cooperate to form first and second toner images on both sides of the image printing medium, the first and the second toner images being opposite in polarity.

To achieve the above object, according to a second aspect of the invention, there is provided an electrostatic both-side printing system in which first image forming means (which includes a toner image bearing means (photoreceptor drum), a charger, an exposure unit, and a developing unit) for forming a first toner image is disposed in opposition to a second image forming means (which includes a toner image bearing means (photoreceptor drum), a charger, an exposure unit, and a developing unit) for forming a second toner image with respect to a medium transporting path for transporting an image printing medium (such as a paper or a plastic sheet).

Before-transfer corotrons are provided facing the photoreceptors of the first and second image forming means. The photoreceptors have the same charge polarity. The before-transfer corotrons set up a state that the charge polarity of a toner image on the photoreceptor of the first image forming means before the toner image is transferred onto the image printing medium is opposite to that of a toner image on the photoreceptor of the second image forming means.

Potential-difference forming means for forming a potential difference between the photoreceptors of the first and the image forming means is provided so that the first toner image is transferred onto one of the sides of the image printing medium passing between the first and the second image forming means, and the second toner image is formed on the other side of the image printing medium. The first and the second image forming means and the potential-difference forming means cooperate to form the first and the second toner images on both sides of the image printing medium. The charge polarities of the first and the second toner images are different from each other.

With the above-mentioned structure, instability of transferring of toner images to both sides of an image printing medium is removed.

In the first and second aspects of the present invention, a roller transferring method or a belt transferring method is employed for the image transferring method. In the roller transferring method, voltage of the polarity that is opposite to the charge polarity of the first toner image is applied to the surface of the image printing medium that is reverse to the print surface thereof.

In the belt transferring method, charge is applied to it through the transfer belt. Therefore, no charge is left on the surface (onto which a second toner image is transferred) of the image printing medium that is reverse to the print surface thereof. In the case of the pressure image transfer using the pressure rollers, no charge is present. For this reason, the "before-transfer toner scattering" phenomenon that takes place in the transferring of the second toner image never takes place in the present invention.

Also, the charge polarity of the first toner image is the same as the polarity of a power source connected to the transferring corotron, which is used for the transferring of the second toner image, or the first toner image is little charged. Under this condition, the toner of the first toner image is not attracted to by an electric field developed by the transferring corotron. Therefore, there is little chance that the image toner flies to the corona wire to soil the corotron with the toner.

Further, stable attachment of the toner images, not yet fixed, transferred onto both sides of the image printing medium is secured when the image printing medium (paper) is transported. The charge polarities of the toner images that are transferred onto both sides of the image printing medium are opposite to each other. Therefore, an electrostatic attractive force is exerted between the toner images on both sides of the image printing medium. The toner images are firmly attached to the image printing medium.

To achieve the above object, according to a third aspect of the invention, there is provided a fixing system for fixing toner images onto an image printing medium in a manner that the image printing medium bearing the toner images on the obverse side and the reverse sides thereof is passed through a nip area between a pair of fixing rollers, characterized in that in the nip area, a rotation speed of a first fixing roller, which comes in contact with a toner image, not yet fixed, formed on the obverse side of the image printing medium is set to be substantially equal to a rotation speed of a fixing roller, which comes in contact with a toner image, not yet fixed, formed on the reverse side of the image printing medium.

With the above-mentioned structure, in the third aspect of the invention, the effective radius of rotation of the first fixing roller is equal to that of the second fixing roller in the nip area. when the image printing medium is moved through the nip area by the fixing rollers, a moving speed of the upper side of the image printing medium is equal to that of the lower side thereof. The stresses Fc and Fe are not caused, and hence no character blur takes place.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS (First Embodiment)

Figure 1:
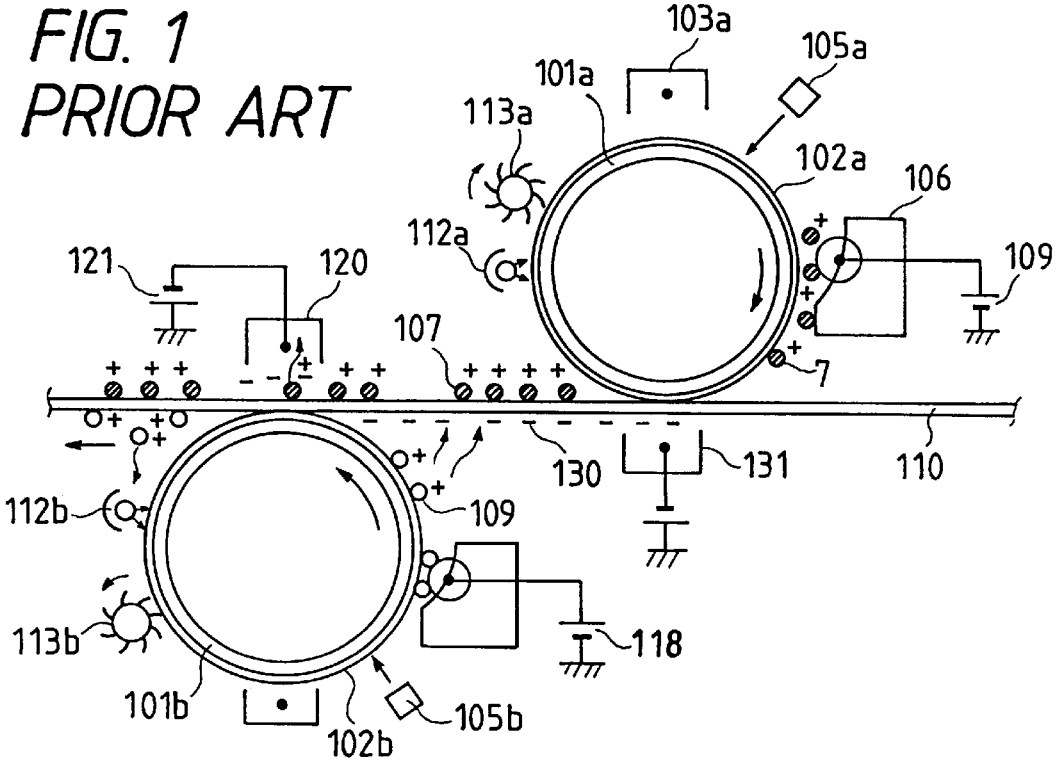
FIG. 1 PRIOR ART
FIG. 1 is a diagram showing photoreceptor drums and their related component parts in a conventional electrostatic both-side printing system.
Figure 2A:
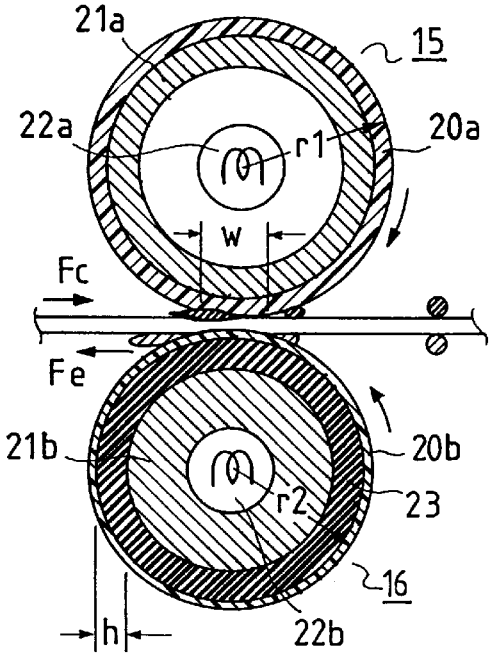
FIG. 2A PRIOR ART
FIGS. 2A and 2B are diagrams showing a fixing state in a conventional printing apparatus.
Figure 2B:
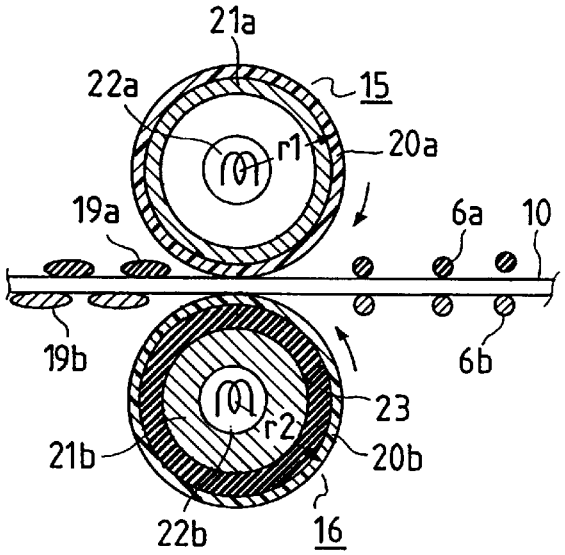
FIG. 2B PRIOR ART
Figure 3:
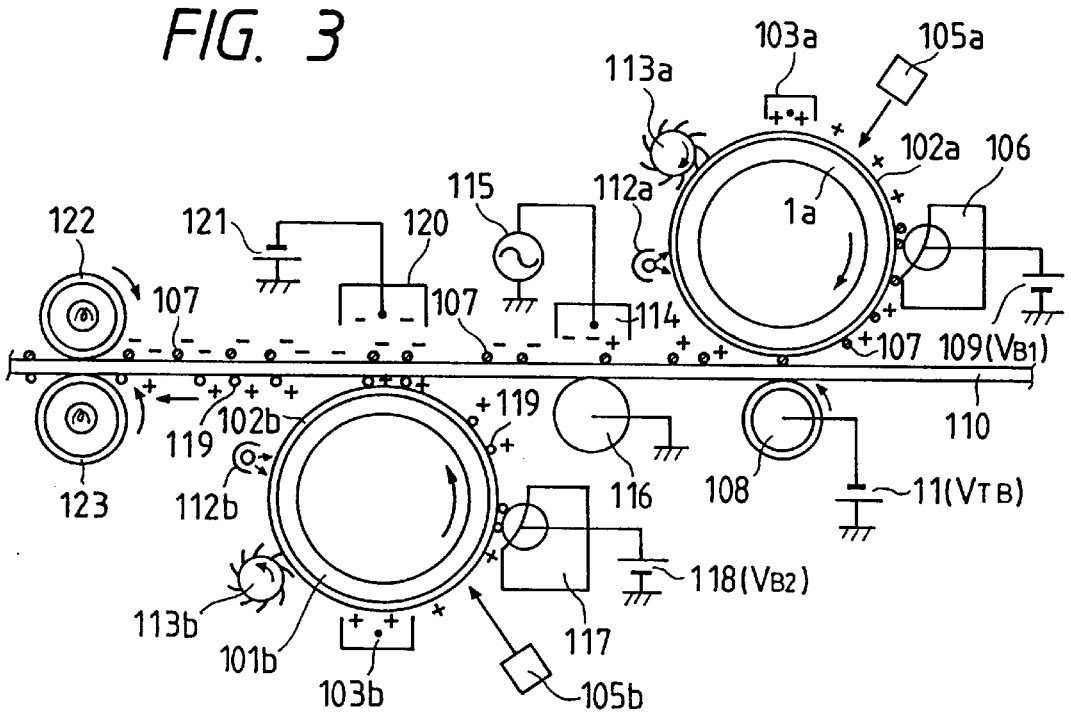
FIG. 3 is a diagram schematically showing an image forming stage of an electrostatic both-side printing system according to a first embodiment of the present invention.

FIG. 3 is a diagram for explaining a first embodiment of the present invention.

As shown, a first photoreceptor drum and a second photoreceptor drum are disposed on both sides of an image printing medium 110, such as a continuous paper, a cut paper, or a plastic sheet. The first photoreceptor drum is constructed such that a photoconductive layer 102*a* made of SeTe is layered on the surface of a conductive substrate 1*a* made of aluminum. Similarly, the second photoreceptor drum is constructed such that a photoconductive layer 102*b* made of SeTe is layered on the surface of a conductive substrate 101*b* made of aluminum.

A charger 103*a* applies positive charge onto the surface of the first photoreceptor drum, and an exposure unit 105*a* irradiates the same with light containing image information, to thereby form an electrostatic latent image thereon. A developing unit 106 develops the latent image into a visual image 107 with toner. Reference numeral 112*a* designates an erasing lamp, and 113*a*, a drum cleaner. Numeral 108 designates a bias roller. A DC bias voltage VTB of the polarity that is opposite to that (positive) of the charge of the toner is applied to the bias roller 108, from a power source 111.

The bias roller 108 is a metallic roller or a metallic roller coated with a conductive rubber. The bias roller 108 rolls to transfer a first toner image 107 onto the upper side of an image printing medium 110. A value of the DC bias voltage VTB depends on the quantity of toner charge and/or a transport speed of the image printing medium 110. Usually, it is within 300 V to 1000 V. Charge emitted from a discharging unit 114, connected to an AC power source 115, adjusts the charge of the first toner image 107 to be negative in polarity or zero (0) in quantity.

In the figure, reference numeral 116 is indicative of a metallic roller 116, which serves as an electrode counter to a corona wire of the discharging unit 114.

A second toner image 119 is formed on the photoconductive layer 102*b* of the second photoreceptor drum by a similar process. The charge polarity of the second toner image 119 is also positive. The second toner image 119 is transferred onto the underside of the image printing medium 110 by a transferring corotron 120, which is connected to a negative DC power source 121.

At this time, the first toner image 107 is negative in the charge polarity or neutralized by the discharging unit 114. Accordingly, the first toner image 107 is not attracted to the corotron wire of the transferring corotron 120. Accordingly, the transferring corotron 120 is not soiled with the toner.

The transferring corotron 120 pours forth negative charge onto the upper side of the image printing medium 110 and the first toner image 107. The polarity of the charge on the upper side of the image printing medium 110 is opposite that of the charge on the lower side thereof. Accordingly, the charges on both sides of the image printing medium 110 attract to each other, with the image printing medium 110 intervening therebetween. The first and the second toner images 107 and 119 are firmly stuck onto both sides of the image printing medium 110. The second toner image 119, which is stuck onto the lower side of the image printing medium 110, never drops during the transportation of the image printing medium 110.

The bias roller 108 may be substituted by a pressure roller. In this case, the pressure roller presses the image printing medium 110 against the photoreceptor drum to transfer the first toner image 107 onto the image printing medium 110.

Reference numerals 122 and 123 designate paired heat rolls. Each roller is a called soft roll, which is constructed such that an elastic layer made of silicone rubber or fluororubber is layered on the surface of an aluminum tube, and a film made of the resin of a family of fluorine, which has good release characteristics, such as perfluoroalkoxy copolymer (PFA) or polytetrafluoroethylene (PTFE). The roll contains a heater therein.

For the fixing unit of the one-side fixing type, a pair of a heat roll and a backup roll is used. In the present embodiment of the invention, the images are fixed onto both sides of the image printing medium simultaneously. Because of this, the heat roll pair of the soft roll structure, which has the backup roll function, is used. To secure the function of the soft roll, viz., the elastic layer, 50 $\mu$m or thicker is desirable for the thickness of the elastic layer made of silicone rubber or fluororubber. In the present embodiment, the first and the second toner image bearing means each consist of one photoreceptor drum. To effect a multicolor printing, each toner image bearing means consists of a plural number of photoreceptor drums, as a matter of course.

In the present embodiment, SeTe positively charged is used for the photoconductive layer, and the reversing developing method is used and hence the toner is charged positively. In an alternative, an organic photoconductive material, negatively charged, is used for the photoconductive layer, and the toner is negatively charged. In this case, the polarity of the image transferring unit is opposite to that of the transferring unit of the present embodiment.

(Second Embodiment)

Figure 4:
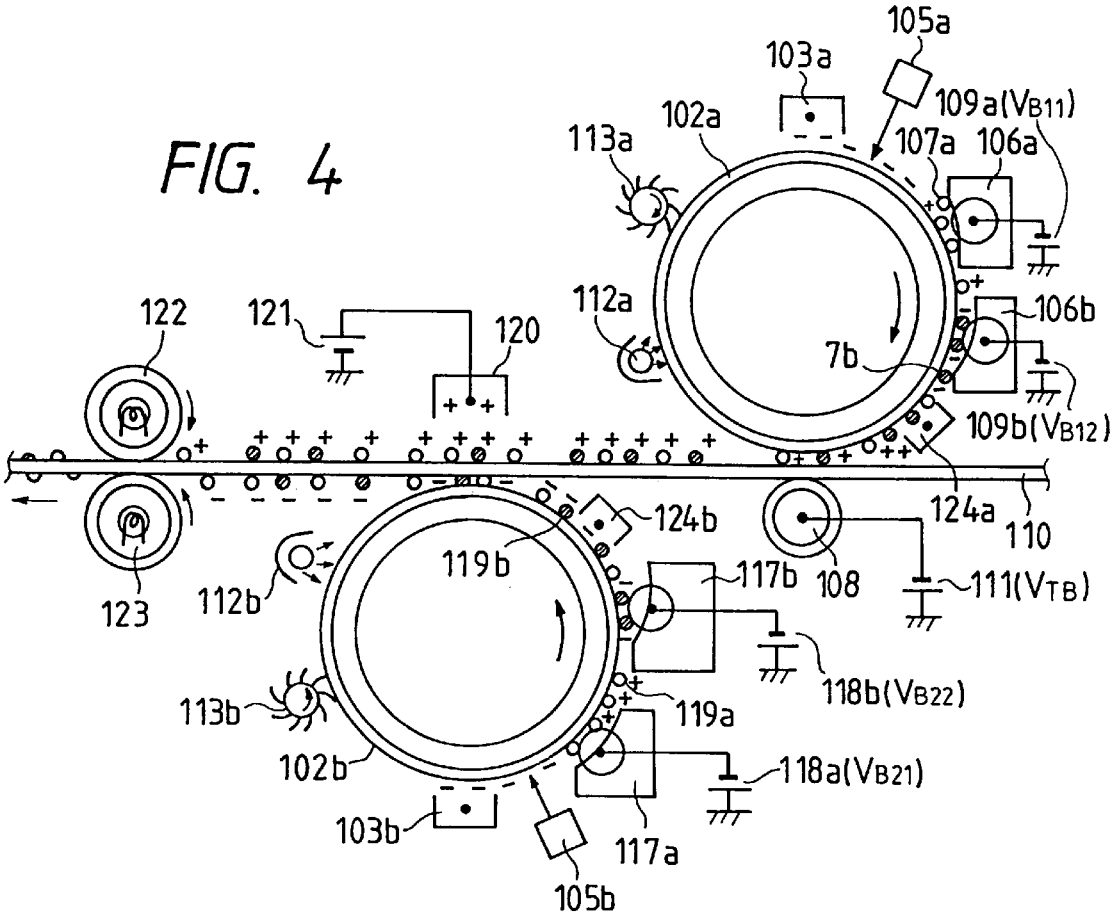
FIG. 4 is a diagram schematically showing an image forming stage of an electrostatic both-side printing system according to a second embodiment of the present invention.
Figure 7:
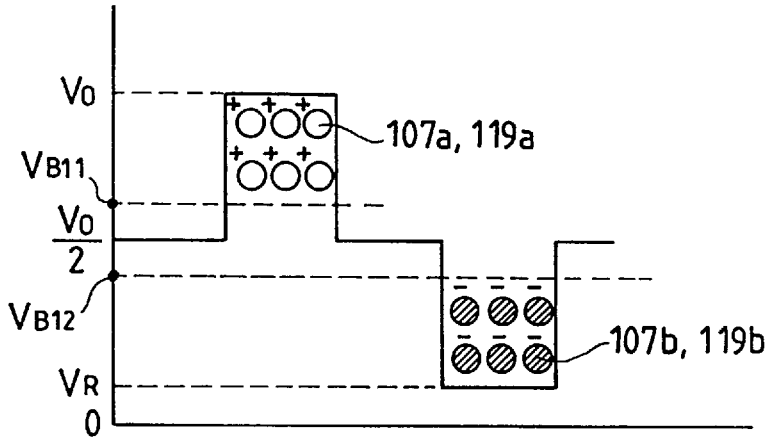
FIG. 7 is a diagram for explaining the principle of a tri-level development.

A second embodiment of the present invention will be described with reference to FIGS. 4 and 7.

The second embodiment of the present invention is different from the first embodiment in that toner images of two colors are formed on the photoreceptor drums by a tri-level developing method.

As shown, a first photoreceptor drum and a second photoreceptor drum are disposed on both sides of an image printing medium 110. The first photoreceptor drum is constructed such that an organic photoconductive layer (OPC) 102*a* is formed on the surface of a conductive substrate 1*a* made of aluminum, for example. Similarly, the second photoreceptor drum is constructed such that an organic photoconductive layer (OPC) 102*b* is formed on the surface of a conductive substrate 1*b* made of aluminum, for example.

The photoreceptor drum is negatively charged by the charger 103*a*. The surface potential of the photoreceptor drum is at V0 (FIG. 7). When the surface of the photoreceptor drum is irradiated with light from an exposure unit 105*a*, an electrostatic latent image is formed at three potential levels V0, V0/2, and VR. A bias voltage VB11 is applied to a developing unit 106*a*, from a bias power source 109*a*. A bias voltage VB12 is applied to a developing unit 106*b*, from a bias power source 109*b*. Positively charged toner 107*a* attaches to a region at the voltage V0 by a normal development. Negatively charged toner 107*b* attaches to a region at the potential VR by the reversing development. In the present embodiment, the toner 107*a* is color toner, and the toner 107*b* is black toner. In this way, a toner image of two colors is formed on the photoreceptor drum by one process. In the present embodiment, V0=700 V, VR=100 V, VB11=500 V, and VB12=300 V.

In the figure, reference numeral 124*a* designates a before-transfer corotron, which is coupled with an AC power source or an AC power source with a positive DC voltage superposed thereon. Positive charge is applied to the toner 107*a* and 107*b* on the photoreceptor drum, so that the negatively charged toner 107*b* is changed to positively charged toner. The first toner image 107 is transferred from the photoreceptor drum to the upper surface of the image printing medium 110 through the image transferring operation by the bias roller 108 applied with the negative voltage. Also on the second photoreceptor drum, a two-color toner image 119 is formed by a similar process. In the present embodiment, reference numeral 19*a* designates positively charged color toner, and 119*b* designates negatively charged black toner. Reference numeral 124*b* designates a before-transfer corotron, which is coupled with an AC power source or an AC power source with a negative DC voltage superposed thereon. Negative charge is applied to the toner 119*a* and 119*b* on the photoreceptor drum, so that the positively charged toner 119*b* is changed to negatively charged toner.

In the present embodiment, the AC voltage is 2 Kv at 1 to 2 Khz, and the absolute value of the DC voltage is 4 to 5 Kv. The second toner image 119 is transferred onto the lower side of the image printing medium 110 by the transferring corotron 120 coupled with the negative DC power source 121.

The charge polarity of the first toner image 107 is positive. Therefore, the discharging unit 114, which is used in the first embodiment, is unneeded. In other words, since the charge polarity of the first toner image 107 is opposite to that of the second toner image 119, there is no need of using the discharging unit 114.

The transferring corotron 120 applies positive charge to the upper side of the image printing medium 110 and to the first toner image 107. Thus, the charge polarity of the toner image on the upper side of the image printing medium 110 is opposite to that of the toner image on the lower side thereof. As a result, an electrostatic attractive force is exerted between the toner images on both sides of the image printing medium 110. The toner images 107 and 119 are firmly attached to the image printing medium 110. During the transportation of the image printing medium 110, the second toner image 119 never drops from the underside of the image printing medium 110.

(Third Embodiment)

Figure 5:
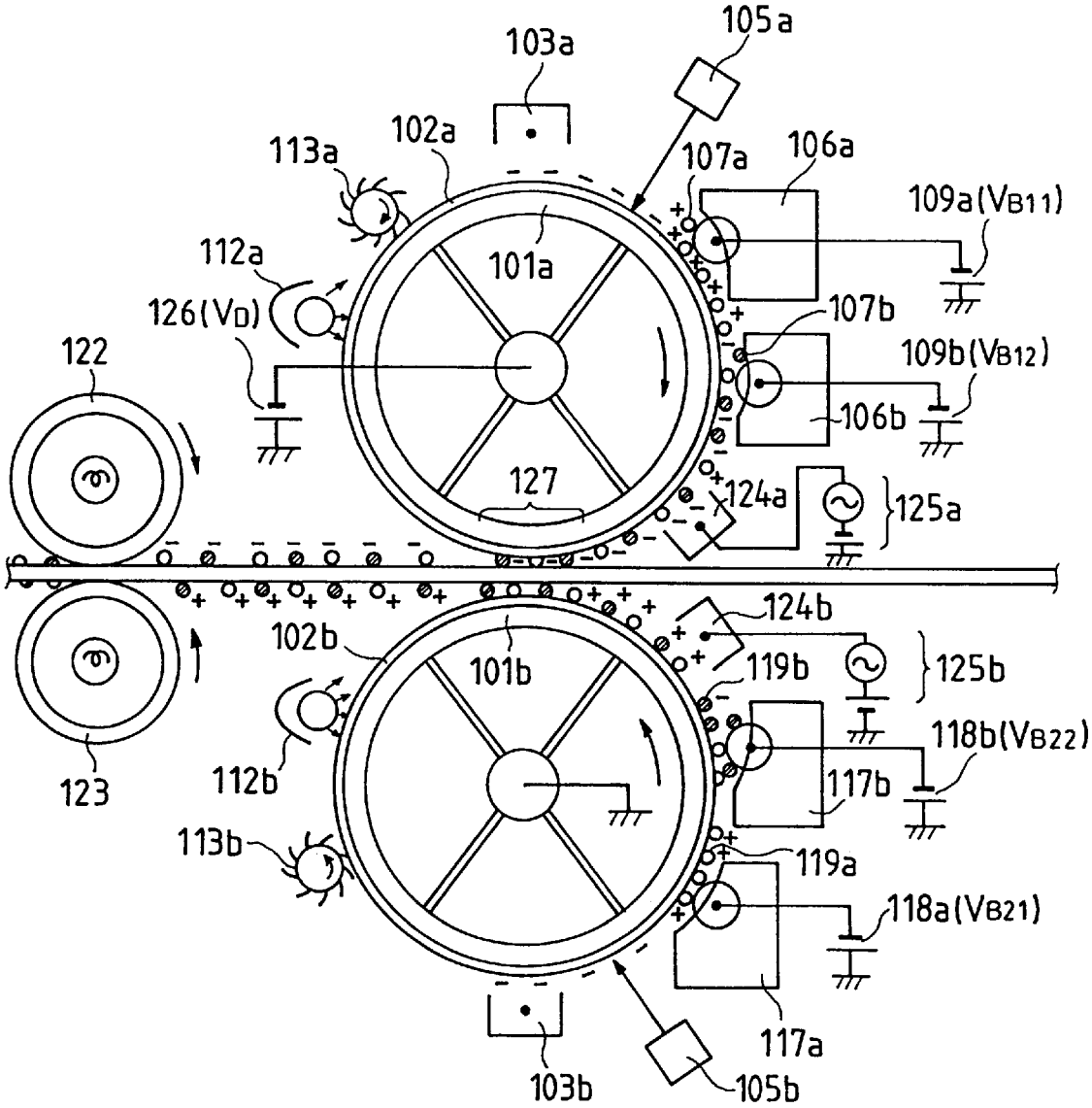
FIG. 5 is a diagram schematically showing an image forming stage of an electrostatic both-side printing system according to a third embodiment of the present invention.

A third embodiment of the present invention will be described with reference to FIGS. 5, 8A and 8B.

The third embodiment of the present invention is different from the first and the second embodiments in that toner images are simultaneously transferred onto both sides of an image printing medium 110 not using the image transferring units. First and second photoreceptor drums are OPC photoreceptor drums.

A DC bias power source 126, which is coupled with the conductive substrate 101*a* of the first photoreceptor drum, applies a DC voltage VD to the conductive substrate. The conductive substrate 101*b* of the second photoreceptor drum is grounded, the conductive substrate 101*b* is at the ground potential. A preset potential difference exists between the conductive substrates 101*a* and 101*b* .

An image of two color toner (107*a*, 107*b*) is formed on the first photoreceptor drum by a process similar to that in the second embodiment. A before-transfer corotron 124*a*, coupled with an AC power source 125*a* with a negative DC power source superposed thereon, applies negative charge to the toner 107*a* and 107*b* of two colors on the photoreceptor drum. The positively charged toner 107*a* and 107*b* are changed into negatively charged toner.

A two-color image of two color toner (119*a*, 119*b*) is formed on the second photoreceptor drum in a similar way. A before-transfer corotron 124*b*, coupled with an AC power source 125*b* with a positive DC power source superposed thereon, applies positive charge to the toner 119*a* and 119*b* of two colors on the photoreceptor drum. The negatively charged toner 119*a* and 119*b* are changed into positively charged toner. A nip area between the first and the second photoreceptor drums serves as an image transferring area.

Figure 8A:
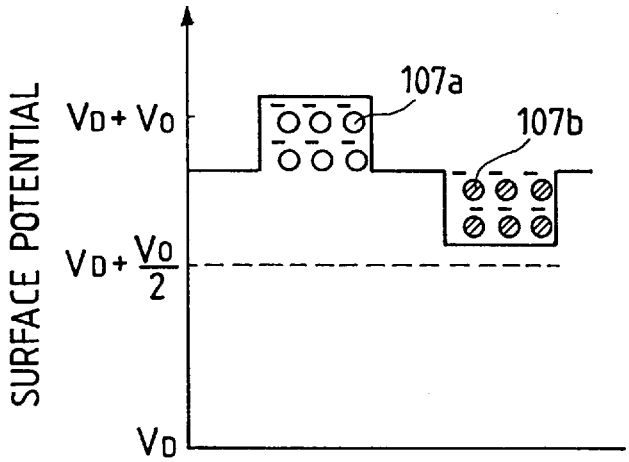
FIGS. 8A and 8B are diagrams useful in explaining the principle to transfer two-color images on both sides of an image printing medium in the electrostatic both-side printing system according to the third embodiment of the present invention.
Figure 8B:
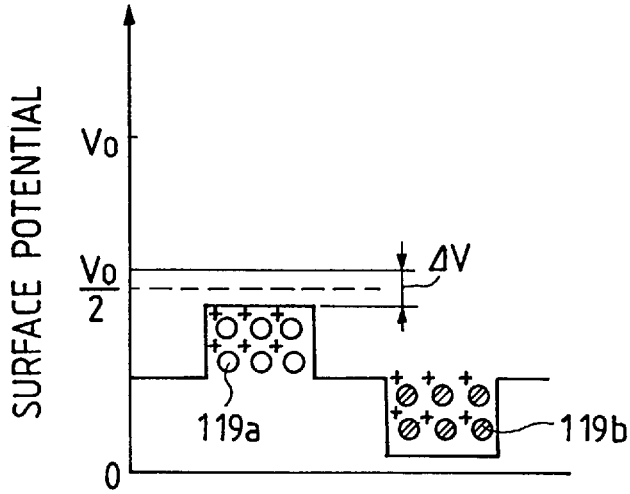

The surface potential of the first and the second photoreceptor drums, and toner potential are illustrated in FIGS. 8A and 8B. In the present embodiment, V0=−700 V. The two-color toner (107*a*, 107*b*) on the first photoreceptor drum are negatively charged by the AC power source 125*a* with a negative DC power source superposed thereon. Accordingly, the surface potential (including toner image portions) of the photoreceptor rises. The two-color toner (119*a*, 119*b*) on the second photoreceptor drum are positively charged by the AC power source 125*b* with a positive DC power source superposed thereon. Accordingly, the surface potential (including toner image portions) of the photoreceptor drops.

A potential difference between the lowest potential area on the first photoreceptor drum and the highest potential area on the second photoreceptor drum is ΔV (absolute value). The potential difference is preferably in the range from approximately −50 to −200 V, although it depends on toner resistance, the quantity of attached toner, and the quantity of applied charge.

As referred to in the first embodiment, −300 V to −1000 V is applied to the bias roller where the roller transfer method is used. In the present embodiment, a DC bias voltage applied to the conductive substrate 101*a* of the first photoreceptor drum is set to a voltage within the range of −250 V to −800 V. With the DC bias voltage thus set, toner images of the opposite polarities are transferred from the first and the second photoreceptor drums onto both sides of the image printing medium 110 in the transfer area in the same image transferring mechanism as by the roller transfer method. Therefore, the toner images can be transferred onto both sides of the image printing medium without the image transferring units. The cost reduction and the size reduction are realized in the present embodiment.

In the present embodiment, the positive potential is applied to the conductive substrate 101*a* of the first photoreceptor drum, while ground potential is applied to the conductive substrate 101*b* of the second photoreceptor drum. Alternatively, ground potential is applied to the conductive substrate 101*a*, while the positive potential is applied to the conductive substrate 101*b*. A preset potential difference may also be produced between the conductive substrates 101*a* and 101*b* by applying different voltage values to these substrates.

The negatively charged OPC, used for the photoreceptor in the above-mentioned embodiment, may be substituted by any other suitable material, for example, positively charged SeTe or $As_2Se_3$, or plasma charged OPC which attracts an attention recently.

(Fourth Embodiment)

Figure 6A:
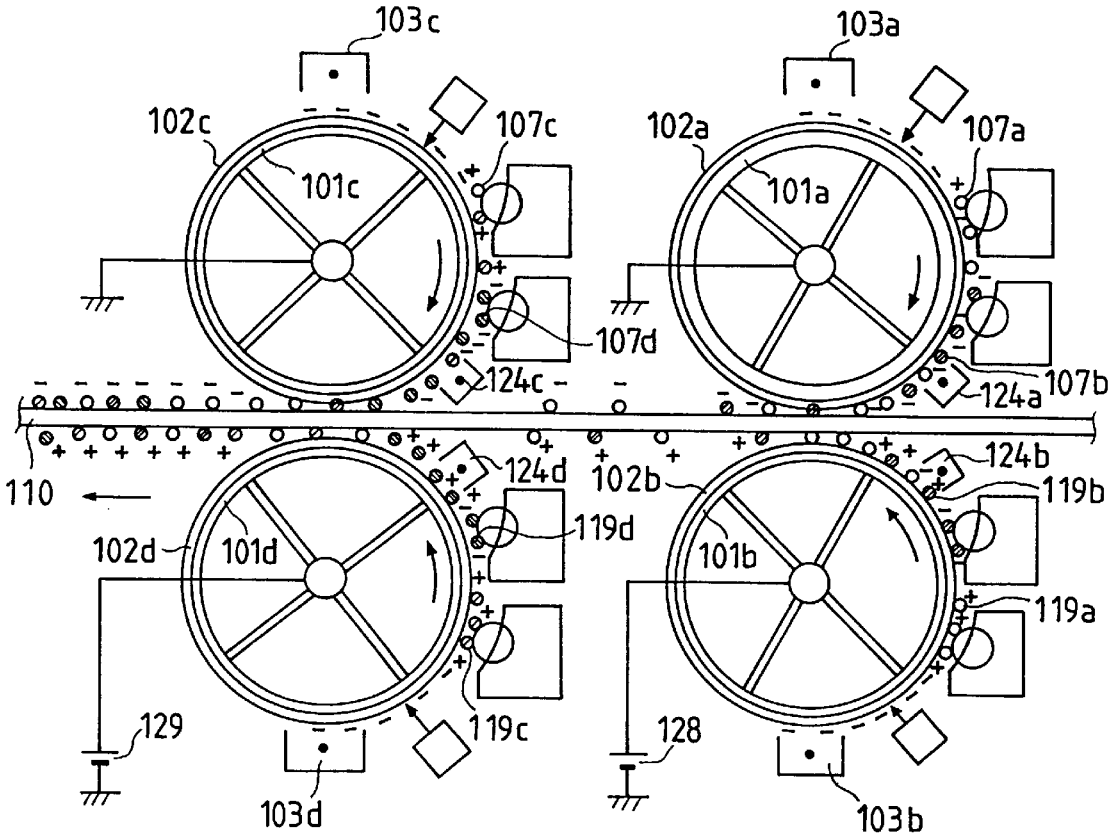
FIGS. 6A and 6B are diagrams schematically showing an image forming stage of an electrostatic both-side printing system according to a fourth embodiment of the present invention.
Figure 6B:
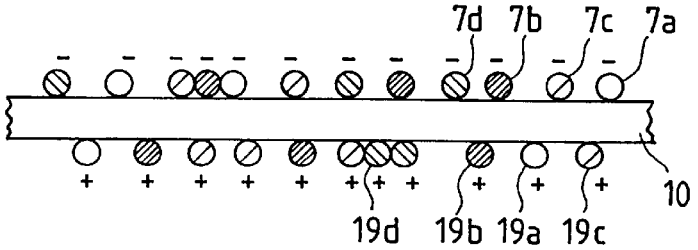

FIGS. 6A and 6B diagrammatically show a fourth embodiment of the present invention. In the embodiment, the invention is expressed in the form of an electrostatic both-side printing system which is capable of printing multi-color images on both sides of an image printing medium by one process. As shown in FIG. 6A, a first toner image bearing means is disposed above the upper side of the image printing medium 110. The first toner image bearing means includes a first photoreceptor drum and a third photoreceptor drum. The first photoreceptor drum is constructed such that an organic photoconductive (OPC) layer 102*a* is formed on the surface of the conductive substrate 101*a*. The third photoreceptor drum is constructed such that an organic photoconductive (OPC) layer 102*c* is formed on the surface of the conductive substrate 101*c*.

A second toner image bearing means is disposed above the lower side of the image printing medium 110. The second toner image bearing means includes a second photoreceptor drum and a fourth photoreceptor drum. The second photoreceptor drum is constructed such that an organic photoconductive (OPC) layer 2*b* is formed on the surface of the conductive substrate 101*b*. The fourth photoreceptor drum is constructed such that an organic photoconductive (OPC) layer 102*d* is formed on the surface of the conductive substrate 101*d*.

In each photoreceptor drum, a toner image of two colors is formed by the tri-level development. Reference numerals 107*a*, 107*b*, 107*c* and 107*d*, and 119*a*, 119*b*, 119*c* and 119*d* designates yellow, magenta, cyan and black toner, respectively.

The toner 107*a* to 107*d* on the first toner image bearing means, disposed above the image printing medium 110, are all negatively charged by before-transfer corotrons 124*a* and 124*c*.

The toner 119*a* to 119*d* on the second toner image bearing means, disposed below the image printing medium 110, are all positively charged by before-transfer corotrons 124*b* and 124*d*.

The conductive substrates 101*a* and 101*c* of the first and the third photoreceptor drums are earthed. Positive DC power sources 128 and 129 as bias power sources are coupled with the conductive substrates 101*b* and 101*d* of the second and the fourth photoreceptor drums.

The toner 107*a* and 107*b*, and 119*a* and 119*b* are simultaneously transferred onto both sides of the image printing medium 110. Then, the toner 107*c* and 107*d*, and 119*c* and 119*d* are simultaneously transferred onto both sides of the image printing medium 110. In this way, the toner of four colors are formed on both sides of the image printing medium 110 without disturbing the transferred images. In this case, the polarity of the charged toner on the upper side of the image printing medium is opposite to that of the charged toner on the lower side thereof.

This state is illustrated in FIG. 6B. If the voltage value of the bias power source 129 is larger than that of the bias power source 128, the toner 107*c* and 107*d*, and 119*c* and 119*d* are well transferred onto the image printing medium. The toner thus transferred are fused and fixed by a both-side fixing unit. The resultant color images are multi-color or full color images.

In the above-mentioned embodiments, a conductive substrate is layered on the surface of each photoreceptor drum. Alternatively, the photoreceptor drum may be constructed such that a conductive substrate is layered on a substrate made of elastic, conductive material or consisting of an elastic layer and a thin conductive layer formed on the elastic layer. Use of such photoreceptor drums provides a uniform and efficient transferring of images onto both sides of the image printing medium.

(Fifth Embodiment)

Figure 9:
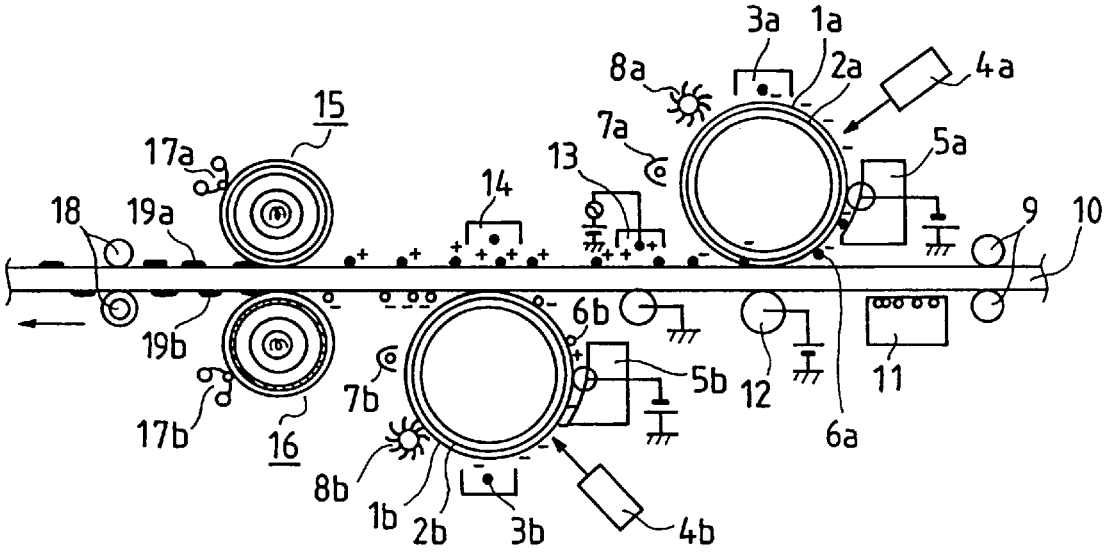
FIG. 9 is a diagram showing an electrostatic image printing apparatus which uses a fixing system according to a fifth embodiment of the present invention.

In FIG. 9, reference numeral 1*a* designates a first photoreceptor drum with a photoconductive layer 2*a* formed thereon. A charger 3*a* applies charge onto the surface of the photoconductive layer 2*a*. An exposure unit 4*a* projects an image pattern onto the charged photoconductive layer 2*a*, to thereby form an electrostatic latent image thereon. A developing unit 5*a* visualizes the latent image into a toner image 6*a*. In this embodiment, an organic photoconductive material (OPC) is used for the photoconductive material. The developing method used in the embodiment is the reversing developing method, which uses negatively charged toner. A positive DC voltage is applied to a bias roller 12. The toner image 6*a* is transferred onto the surface or upper side of an image printing medium (paper) 10 by the bias roller 12.

Reference numeral 7*a* designates an eraser lamp, and 8*a* represents a photoreceptor cleaner. Reference numeral 13 indicates a charge removing unit applied with an AC voltage or an AC voltage with a positive DC voltage superposed thereon. The charge removing unit 13 reduces an amount of charge of the toner image 6a or inverts the charge polarity of the toner image 6*a* (to the positive polarity). Reference numeral 1*b*designates a second photoreceptor drum 1*b* with a photoconductive layer 2*b* formed thereon. As in the first photoreceptor drum, an organic photoconductive material (OPC) is used for the photoconductive material. A toner image 6*b* is formed on the photoreceptor drum by the reversing developing method. The toner image 6*b*, negatively charged, is attracted and transferred to the reverse or lower side of a paper of which the surface is positively charged by an image transferring corotron 14.

Figure 10:
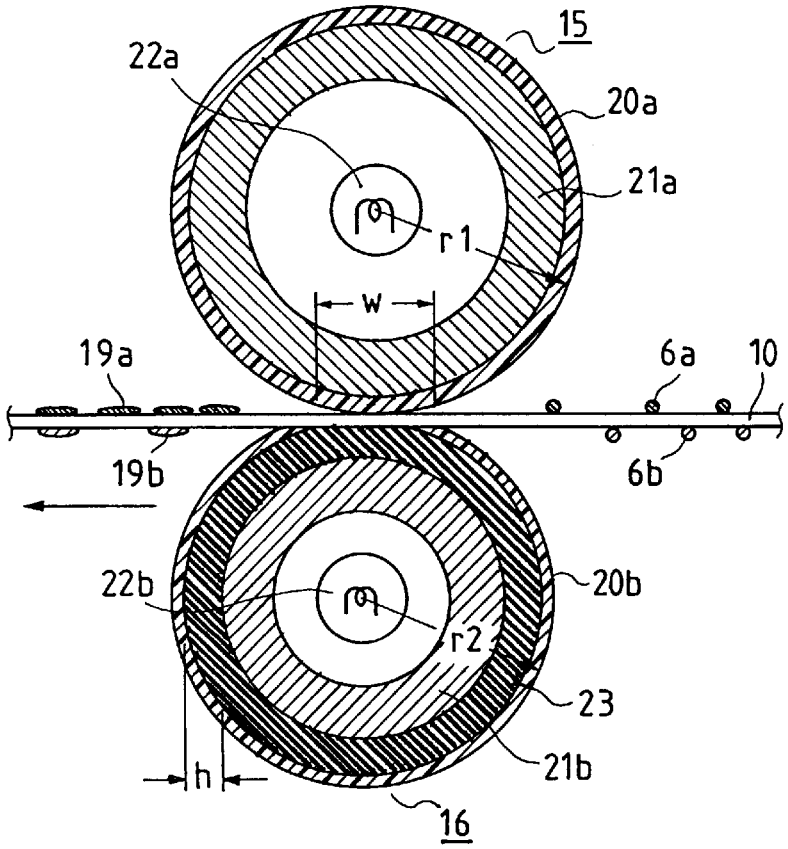
FIG. 10 is a diagram showing the construction of a fixing roller pair of the fixing system according to the fifth embodiment of the present invention.

The toner images 6*a* and 6*b* thus formed are fixed onto both sides of the paper by a pair of fixing rolls 15 and 16 constructed shown in FIG. 10. The fixed toner images are designated by reference numerals 19*a* and 19*b*. Reference numerals 17*a* and 17*b* stand for cleaners for the paired fixing rollers. In the figure, reference numeral 9 designates a feed roller pair for feeding the image printing medium; 11, a paper brake; and 18, an out roller pair.

In the fixing system of the present embodiment, reference numeral 15 indicates a hard roll as a drive roller; and 16 indicates a soft roll as a follower roller. Further, reference numerals 20*a* and 20*b* are representative of PFA resin layers; and 23, a Si rubber layer.

The upper fixing roller is a hard roller as a drive roller, and the lower fixing roller 16 is a soft roller with an elastic layer, as a follower roller. The upper and the lower fixing rollers are compressed together by a preset load, to thereby form a nip area of the width W. In the nip area, the lower fixing roller is deformed.

When the fixing roll 16 follows the fixing roll 15, the angular speed ω of the former is equal to that of the latter. If the effective radii of the rolls are equal to each other, the rotating speeds U1 and U2 of them are also equal. This is realized by making the effective radius $r_2$ , of the under fixing roll equal to the radius $r_1$ , of the upper fixing roll (equal to the effective radius since it is a hard roll).

When the fixing roll pair is used for a long time and the elastic characteristic of the elastic layer is degraded, the pressing force to the fixing roll pair is adjusted so as to obtain a preset nip width W.

(Sixth Embodiment)

Figure 11:
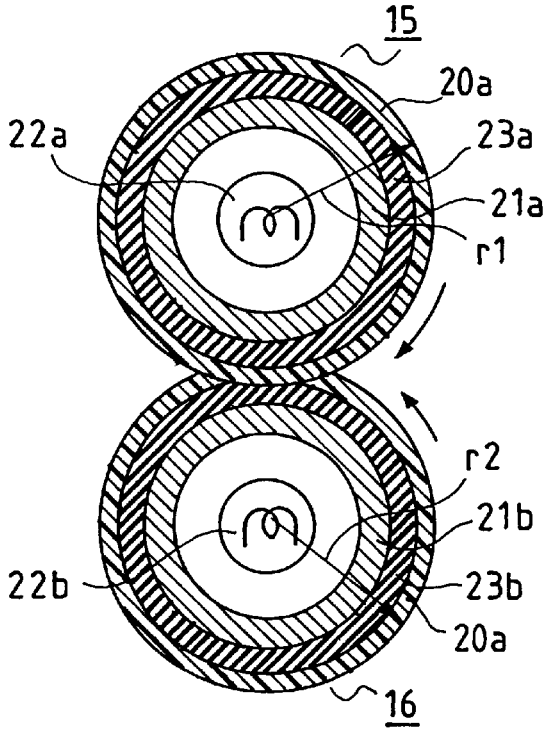
FIG. 11 is a diagram showing the construction of a fixing roller pair of the fixing system a sixth embodiment of the present invention.

In the fifth embodiment, the upper fixing roller 15 is the hard roll, and the lower fixing roller 16 is the elastic roll. In a sixth embodiment of the invention to follow, as shown in FIG. 11, the upper and the lower fixing rollers are constructed with elastic rolls. A recent social demand on ecology increases the amount of the recycled paper used for the image printing medium. The irregularity on the surface of the recycled paper, also called a coarse paper, is greater larger than that of the quality paper, approximately 50 μm at its maximum. The surface of the hard roll cannot follow such a great fluctuation of the paper surface. The hard roll can insufficiently fix toner onto the paper. The resultant toner fixing strength is weak. For this reason, the soft roll with the elastic layer is preferable for the recycled paper. In the present embodiment, the soft rolls of the equal radii are used for both the upper and the lower fixing rolls 15 and 16. One of the soft rolls serves as a drive roll and the other, as a. follower roll. Accordingly, the speed of the upper side of the image printing medium is equal to that of the lower side thereof when it passes the nip area. The sixth embodiment suffers from no character blur.

In the construction of the fixing roll pair, both the rolls may be designed to be exactly the same in the following specified items: the metallic roller diameter, the thickness and the material of the elastic layer, and the thickness and the material of the release resin layer. The rolls may be different in the thickness of the elastic layers and the release resin layers. A return roller is provided upstream of a medium transport brake mechanism. The return roller operates to return the paper upstream by a preset distance (approximately 1 inch) in preparation for the restart of printing. An out roller for applying a tension to the image printing medium is provided downstream of the fixing system.

The thickness h of the elastic layers 23*a* and 23*b* is preferably thin in order to secure a high speed fixing, viz., a good thermal conduction from the heat from the lamps 22*a* and 22*b*. If the elastic layers are too thin, those lose their function. Our experiment showed that 50 μm or thicker was preferable for the thickness h of the elastic layers 23*a* and 23*b*.

Soft rolls for the fixing rollers may be exactly the same in the dimensional specifications or different in the thickness of the elastic layers and the release resin layers.

(Seventh Embodiment)

Figure 12:
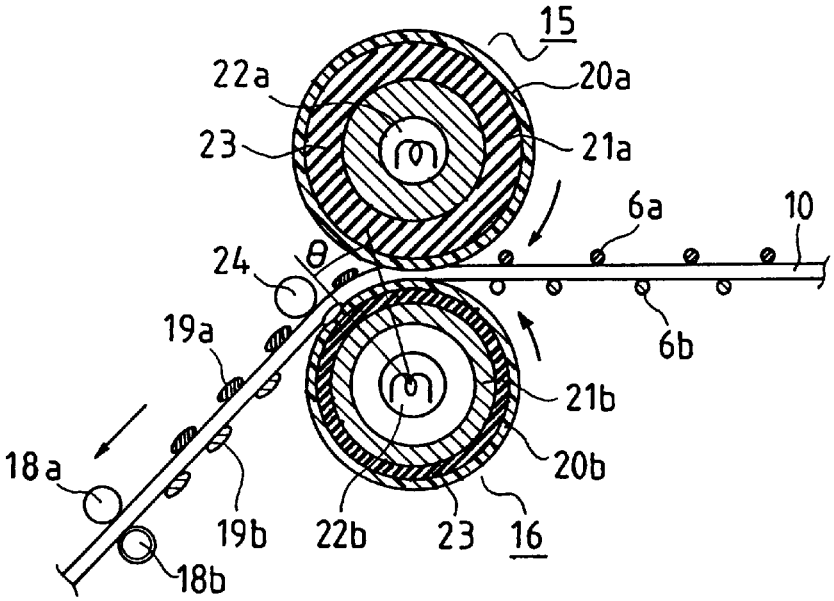
FIG. 12 is a diagram showing the construction of a fixing roller pair of the fixing system according to a seventh embodiment of the present invention.

FIG. 12 shows a seventh embodiment of the present invention. For the construction of the fixing system, the upper fixing roller is a hard roll, and the lower fixing roller 16 is an elastic roll. To secure a fixing strength, it is required that the fixing energy applied to the toner on one side of the image printing medium is equal to that to the toner on the other side thereof. Since the elastic roll has the elastic layer, its thermal resistance is correspondingly large. As a result, the amount of thermal energy entering the paper per unit time is reduced. There are two ways to equally put the thermal energy into the toner on the upper and the lower sides of the paper when it passes the fixing system.

1) The power of a heater lamp 22*b* of the soft roll 16 is set to be larger than that of a heater lamp 22*a* of the hard roll 15.

2) The power of a heater lamp 22*b* of the soft roll 16 is set to be equal to that of a heater lamp 22*a* of the hard roll 15. As shown in FIG. 12, after the paper passes the nip area, it is forcibly put on the elastic roll 16 by means of a winding roll 24, to thereby supply the quantity of heat to the toner on the lower side of the paper for making up for the deficiency of heat. θ indicates a winding angle of the paper. The angle θ may be more reduced as a thermal conductance of silicon rubber used as an elastic layer is larger and the elastic layer is thinner. Reference numeral 18 designates an out roller. The out roller stretches the paper to remove a slack in the winding region and to prevent the character blur. With those measures, the toner fixing strength on the upper side of the paper is made equal to that on the lower side thereof.

(Eighth Embodiment)

Figure 13A:
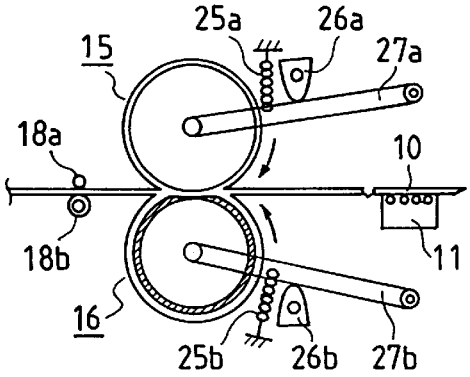
FIGS. 13A and 13B are diagrams showing the construction of a fixing-roller pair retracting mechanism according to an eighth embodiment of the present invention.
Figure 13B:
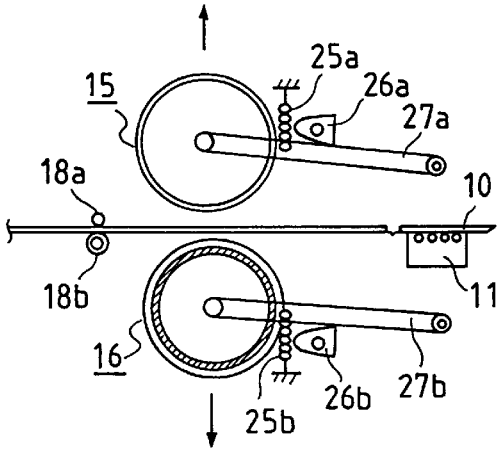

FIG. 13A and 13B are diagrams for explaining an eighth embodiment of the present invention. An operation of a both-side simultaneous fixing system using the heat rolls when it is in a print interrupt mode, will be described. The shafts of the upper and the lower heat rolls are coupled with arms 27*a* and 27*b* with springs 25*a* and 25*b* coupled therewith, respectively. In a print mode, cams 26*a* and 26*b* press the upper and the lower heat rolls together, to thereby form a nip area therebetween. When a paper bearing a toner image thereon passes through the nip area, the toner image is fixed to the paper. In a print interrupt mode, a medium brake 11 operates to stop the transport of the paper. And through the operations of cams 26*a* and 26*b*, the upper and the lower heat rolls move away from the paper. An out roll 18*b* is a scuff roll. By the out roll, the paper is pulled with such a tensile stress as not to break the paper. Therefore, the paper is not slacked. By a transport roller 9, the paper is moved upstream a preset distance (e.g., 1 inch) in preparation for a restart of printing operation.

As a result, it is possible to prevent the hot offset of toner arising from the increase of the heating time in a print interrupt mode, and the character blur owing to an improper nipping between the upper and the lower heat rolls when the printing operation restarts.

(Ninth Embodiment)

Figure 14A:
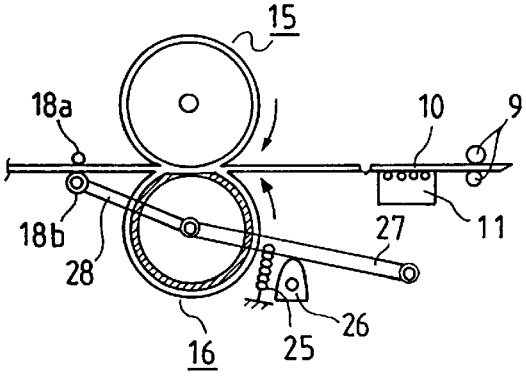
FIGS. 14A and 14B are diagrams showing the construction of another fixing-roller pair retracting mechanism according to a ninth embodiment of the present invention.
Figure 14B:
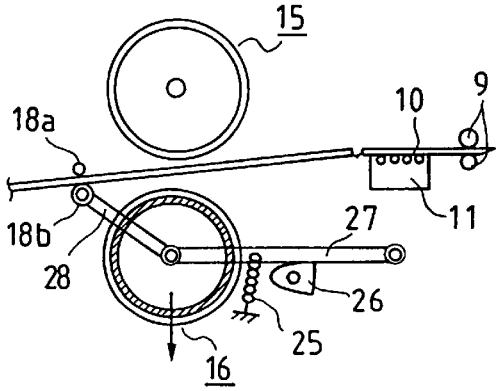

FIGS. 14A and 14B show a ninth embodiment of the present invention. The embodiment of FIGS. 14A and 14B is different from that of FIGS. 13A and 13B in the structure to separate the upper and the lower heat rolls from the paper in a print interrupt mode. The shaft of the lower heat roll is coupled with an arm 27 with a spring 25 attached thereto. An out roller 18b is coupled with the shaft of the lower heat roll through an arm 28. In a print mode, a cam 26 pushes upward the lower fixing roll 16 and the out roller 18*b* to press them against the upper fixing roll. A fixing nip area is formed between the upper and the lower fixing rolls. A paper 10 is nipped by a pair of out rollers 18*a* and 18*b* and transported forward. In this case, only the movement of the lower fixing roller suffices.

As seen from the foregoing description, according to the first and second aspects of the present invention, there are the following beneficial advantages.

1) Less scattering of toner and less disturbing of the image are created in transferring the images onto both sides of the image printing medium. The resultant images are high in quality.

2) The charge polarity of the toner images on one side of the image printing medium is opposite to that of the toner images. Therefore, the electrostatic attractive force exerting between them firmly attaches the toner images both sides of the image printing medium. Therefore, toner never drops from the underside of the image printing medium when the medium is transported.

3) Provision of a potential-difference generating means between the photoreceptors of first and second image forming means eliminates the use of the image transferring units. This fact leads to size reduction and cost reduction of the system.

4) Multi-color or full color images are formed on both sides of the image printing medium by one process.

Also, according to the third aspect of the present invention, there can be provided a fixing system little suffering from the offset and the character blur.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing system for simultaneously fixing toner images formed on both sides of an image printing medium, comprising:

a pair of first and second fixing rollers defining a nip area therebetween, the image printing medium bearing the toner images on an obverse side and a reverse side of the image printing medium being passed through said nip area;

wherein, in the nip area, a rotation speed of said first fixing roller, which comes in contact with a toner image, not yet fixed, formed on the obverse side of the image printing medium is set to be substantially equal to a rotation speed of said second fixing roller, which comes in contact with a toner image, not yet fixed, formed on the reverse side of the image printing medium; and wherein each of said first and second fixing rollers comprises a metallic roller, an elastic layer formed on said metallic roller, and a release resin layer, and wherein said metallic roller, the elastic layer and the release resin layer of said first and second fixing rollers have exactly the same diameters, and the thickness of said elastic layer is 50 $\mu$m or thicker.

2. A fixing system according to claim 1, in which the effective radius of rotation of said first fixing roller is equal to that of the second fixing roller in the nip area.

3. A fixing system for fixing toner images onto an image printing medium, comprising:

a pair of first and second fixing rollers defining a nip area therebetween, the image printing medium bearing the toner images on an obverse side and a reverse side of the image printing medium being passed through said nip area;

wherein, in the nip area, a rotation speed of said first fixing roller, which comes in contact with a toner image, not yet fixed, formed on the obverse side of the image printing medium is set to be substantially equal to a rotation speed of said second fixing roller, which comes in contact with a toner image, not yet fixed, formed on the reverse side of the image printing medium;

in which said first roller comprises a hard roll of radius $r_1$ including a metallic roller and a release resin layer layered on said metallic roller, said second roll comprises a soft roll of radius $r_2$ including a metallic roller, an elastic layer formed on said metallic roller, in which the image printing medium emanating from said nip area contacts a surface of said second fixing roller having said elastic layer, at a preset angle.

4. A fixing system for simultaneously fixing toner images formed on both sides of an image printing medium, comprising:

a pair of first and second fixing rollers defining a nip area therebetween, the image printing medium bearing the toner images on an obverse side and a reverse side of the image printing medium being passed through the nip area;

wherein, in the nip area, a rotation speed of said first fixing roller, which comes in contact with a toner image, not yet fixed, formed on the obverse side of the image printing medium is set to be substantially equal to a rotation speed of said second fixing roller, which comes in contact with a toner image, not yet fixed, formed on the reverse side of the image printing medium;

a medium transport brake mechanism provided upstream of said fixing rollers when viewed in a direction of transporting the image printing medium;

a medium feed roller provided upstream of said medium transport brake mechanism when viewed in the direction of transporting the image printing medium; and an out roller provided downstream of said fixing rollers when viewed in the direction of transporting the image printing medium;

wherein after said fixing rollers are retracted from the upper and the lower sides of the image printing medium, said image printing medium is moved upstream by said medium feed roller.

5. A fixing system according to claim 4, in which when said fixing system is in a fixing interrupt mode, said medium brake mechanism operates to stop the transporting of the image printing medium, and said fixing rollers are retracted from the upper and lower sides of the image printing medium.

6. A fixing system according to claim 4, in which when starting the fixing operation, said out roller stretches the image printing medium to remove a slack from the image printing medium, said fixing rollers compress the image printing medium, said medium brake mechanism is released, and said fixing rollers rotate to start the fixing operation.

* * * * *